US009837763B2

(12) United States Patent
Shibata

(10) Patent No.: US 9,837,763 B2
(45) Date of Patent: Dec. 5, 2017

(54) ELECTRICAL CONNECTOR

(71) Applicant: Molex, LLC, Lisle, IL (US)

(72) Inventor: Shinsuke Shibata, Yamato (JP)

(73) Assignee: Molex, LLC, Lisle, IL (US)

( * ) Notice: Subject to any disclaimer, the term of this patent is extended or adjusted under 35 U.S.C. 154(b) by 0 days.

(21) Appl. No.: 15/317,042

(22) PCT Filed: Jun. 22, 2015

(86) PCT No.: PCT/US2015/036875

§ 371 (c)(1),
(2) Date: Dec. 7, 2016

(87) PCT Pub. No.: WO2015/200160

PCT Pub. Date: Dec. 30, 2015

(65) Prior Publication Data

US 2017/0125941 A1 May 4, 2017

(30) Foreign Application Priority Data

Jun. 27, 2014 (JP) ..... 2014-132722

(51) Int. Cl.
*H01R 13/629* (2006.01)

(52) U.S. Cl.
CPC ..... *H01R 13/62938* (2013.01)

(58) Field of Classification Search
CPC ..... H01R 13/62938
USPC ..... 439/310, 136, 152–153, 157, 160, 259, 439/266, 347, 372, 374
See application file for complete search history.

(56) References Cited

U.S. PATENT DOCUMENTS

| | | | | |
|---|---|---|---|---|
| 5,681,175 | A | 10/1997 | Busse et al. | |
| 6,019,620 | A | 2/2000 | Kodama et al. | |
| 6,217,354 | B1 | 4/2001 | Fencl et al. | |
| 6,345,995 | B1 | 2/2002 | Bigotto et al. | |
| 6,666,697 | B2 | 12/2003 | Yamashita | |
| 6,824,406 | B1 * | 11/2004 | Sharples | H01R 13/62977 439/157 |
| 7,568,925 | B2 * | 8/2009 | Ciriello | H01R 13/62977 439/157 |
| 8,235,742 | B2 * | 8/2012 | Komiyama | H01R 13/62911 439/157 |
| 2008/0166903 | A1 | 7/2008 | Pittenger et al. | |

FOREIGN PATENT DOCUMENTS

JP 2015-216068 A 12/2015

* cited by examiner

*Primary Examiner* — Edwin A. Leon
(74) *Attorney, Agent, or Firm* — Clarence R. Moon

(57) ABSTRACT

A connector includes an embodiment that is equipped with a lever configured to turn around a turning shaft portion provided on the outside of an outer shell portion of a housing of the connector. The lever is equipped with a cam shaft portion inserted through a window formed in the outer shell into a cam groove formed in a slider. The lever further includes a cam shaft portion having a base portion and a hook portion wherein the hook portion extends beyond and engages an edge of the window preventing the cam shaft from detaching from the cam groove.

8 Claims, 14 Drawing Sheets

ELECTRICAL CONNECTOR

RELATED APPLICATIONS

This application claims priority to Japanese Application No. 2014-132722, filed Jun. 27, 2014, which is incorporated herein by reference in its entirety.

FIELD OF THE INVENTION

The present disclosure relates to a connector and, more specifically, to a locking structure incorporated on the connector.

DESCRIPTION OF RELATED ART

A typical lever-type electrical connector includes an assembly of a first connector or housing and a second connector or header. To mate the connectors together, the assembly has an actuating or assist lever mounted for pivoting on the first connector with pivoting of the lever causing the first and second connectors to shift between unmated and fully mated configurations. To this end, the actuating lever and the second connector typically have a cam groove and a cam follower arrangement for drawing the second connector into mating condition with the first connector in response to pivoting of the lever. Such connectors are commonly used in the automotive industry; however, other uses are also possible.

Accordingly, there is a need for a lever actuator for an electrical connector assembly that generates a more efficient mechanical advantage, particularly with large electrical connectors that require the lever actuator to be able to generate large output forces without requiring large input actuator forces on the lever. In addition, a lever actuator that is not deformed as it is pivoted would be desired.

SUMMARY OF THE INVENTION

In a connector of the prior art, the interlocking member, the lever, and the housing are arranged in sequential order in a direction extending from the inside towards the outside, and the lever is accommodated inside a lever accommodating groove formed in the housing. However, in this structure, the range of movement for the lever is limited and therefore a purpose of the present disclosure to provide a connector which is able to expand the range of movement for a lever.

In order to solve this problem, the present disclosure is a connector comprising: a housing including an outer shell portion facing a holding portion in a second direction orthogonal to a first direction when the first direction is the direction in which the holding portion holding the terminals is inserted into an opposing housing; a slider held movably in a third direction orthogonal to the first direction and the second direction between the holding portion and the outer shell portion, the slider having an engaging portion switch between engaging and disengaging an engaging protrusion provided on the opposing housing in response to the position of the slider; and a lever able to turn around a turning shaft portion provided to the outside of the outer shell portion in the second direction, the lever having a cam shaft portion inserted through a window formed in the outer shell portion into a cam groove formed in the slider.

In one aspect of the present disclosure, the can shaft portion may have a hook portion hooking the edge of the window in the outer shell portion on the inside of the outer shell portion in the second direction.

In another aspect of the present disclosure, the hook portion may protrude towards the far side from the turning shaft portion relative to the base portion through which the window passes, and the distance from the turning shaft portion of the outer shell portion to the far side of the window may be smaller than the distance from the turning shaft portion of the lever to the far end of the hook portion but larger than the distance from the turning shaft portion of the lever to the far end of the base portion.

In another aspect of the present disclosure, the cam shaft portion of the lever may be inserted through the window of the outer shell portion, and the turning shaft portion of the outer shell portion may be inserted into the turning shaft hold of the lever while the lever is being elastically deformed.

In another aspect of the present disclosure, the distance from the turning shaft portion of the outer shell portion to the far edge of the window may be smaller than the distance from the turning shaft portion of the lever to the far end of the hook portion along the entire far edge.

In another aspect of the present disclosure, the edge of the window near the turning shaft portion may include a portion whose distance from the far edge is greater than the distance from the near end of the cam shaft portion including the hook portion to the far end, and a portion whose distance is smaller.

In another aspect of the present disclosure, the hook portion may have a shape whose width narrows as the far end is approached.

In another aspect of the present disclosure, the turning shaft portion may have a hook portion protruding on the opposite side from the hook portion of the cam shaft portion.

In the present disclosure, the lever is arranged to the outside of the outer shell portion, which expands the range of movement for the lever.

BRIEF DESCRIPTION OF THE DRAWINGS

This application is illustrated by way of example and not limited in the accompanying figures in which like reference numerals indicate similar elements and in which.

DETAILED DESCRIPTION OF THE PREFERRED EMBODIMENTS

The following is an explanation of an embodiment of the present disclosure with reference to the drawings.

Figure 1:
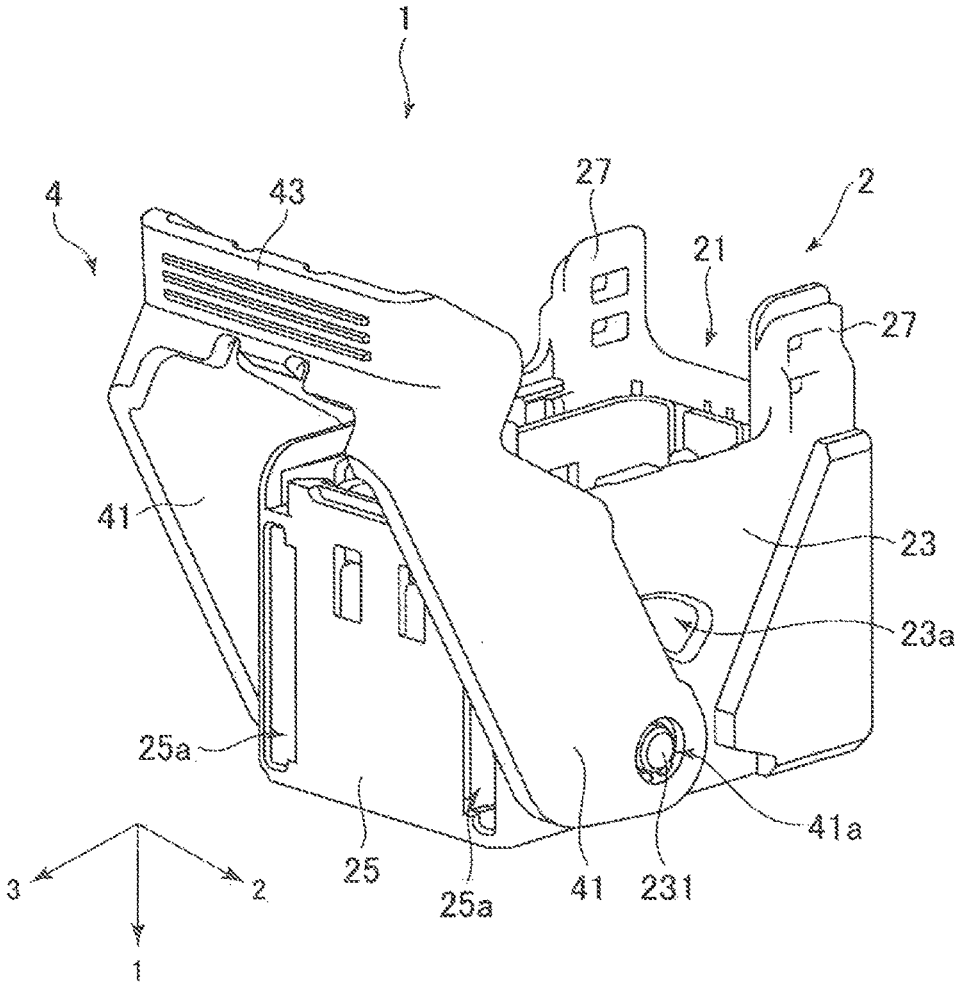
FIG. 1 is a perspective view of the connector in an embodiment of the present disclosure.
Figure 2:
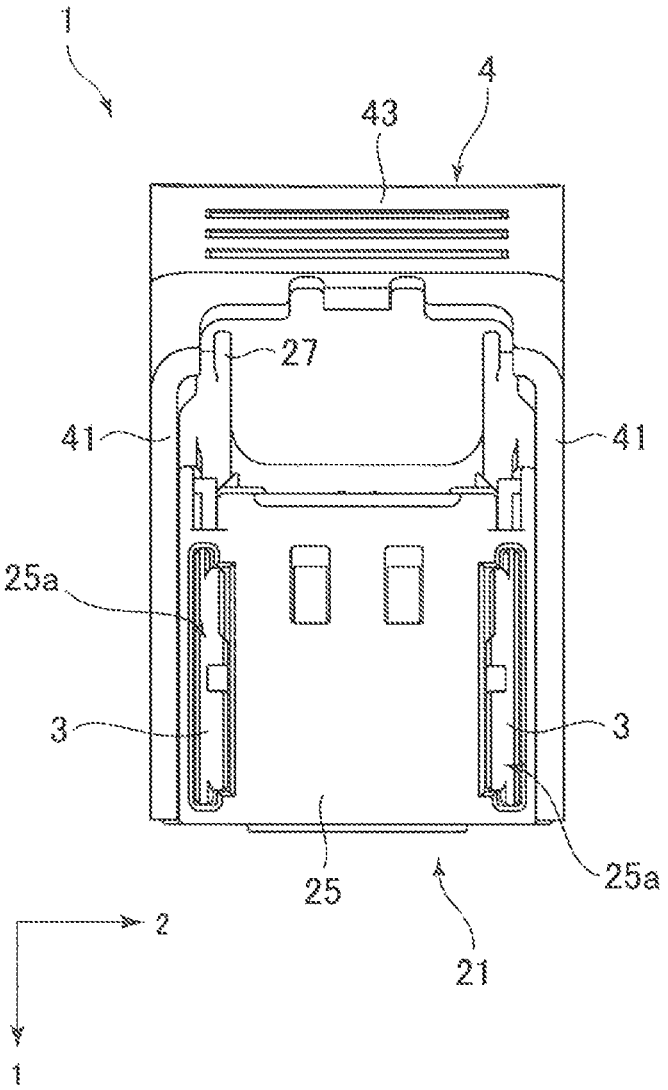
FIG. 2 is a front view of the connector.
Figure 3:
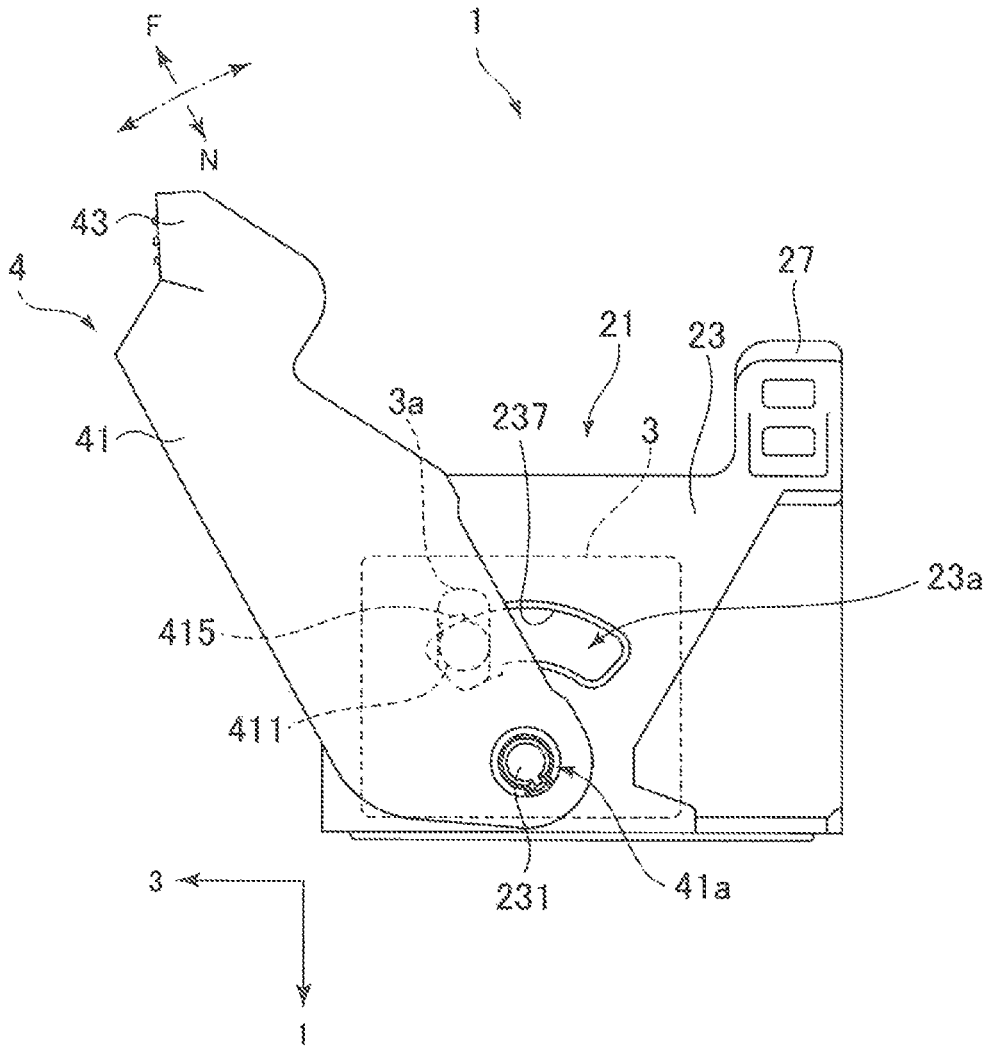
FIG. 3 is a right side view of the connector.
Figure 4:
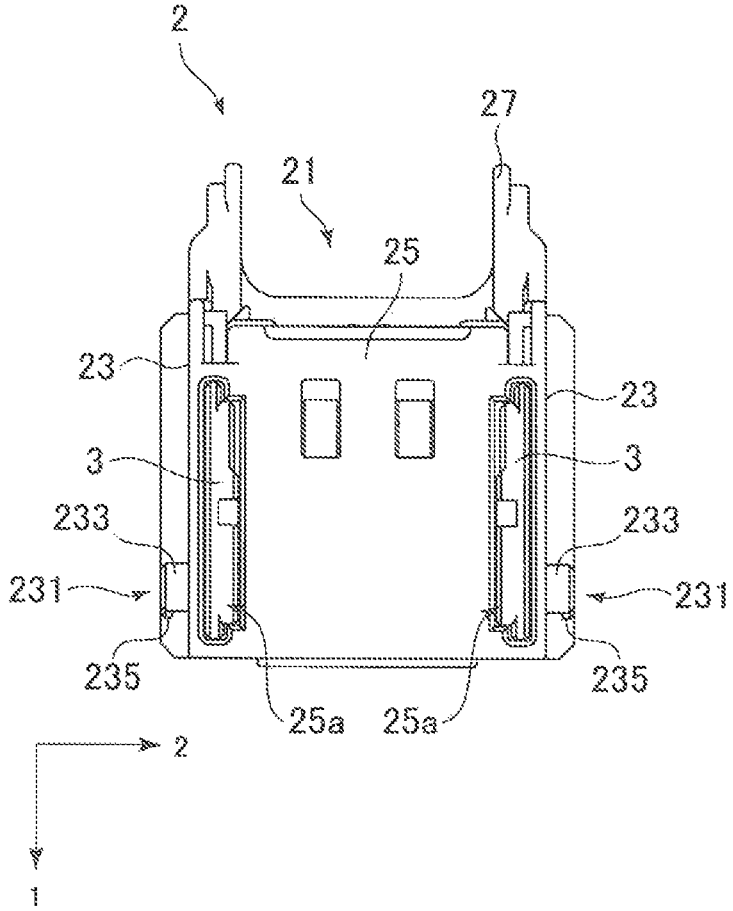
FIG. 4 is a front view of the housing.
Figure 5:
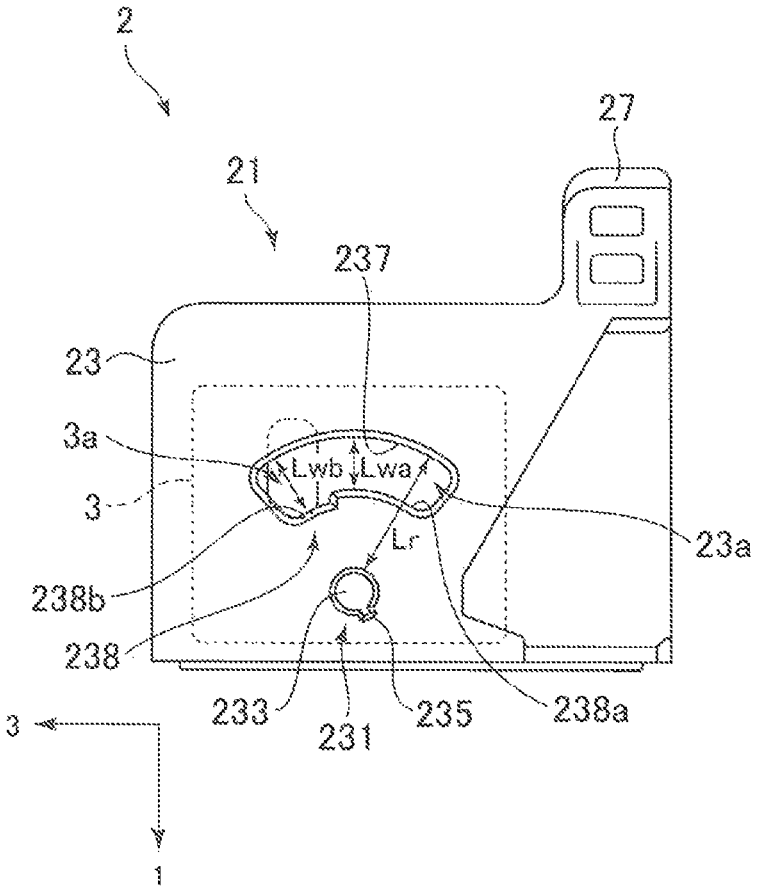
FIG. 5 is a right side view of the housing.
Figure 6:
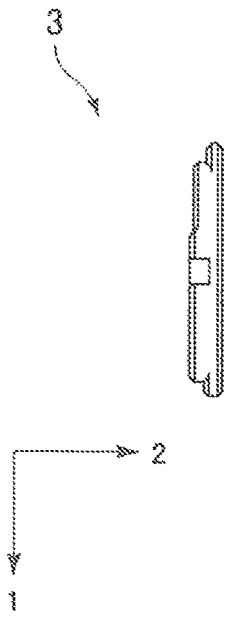
FIG. 6 is a front view of the slider.
Figure 7:
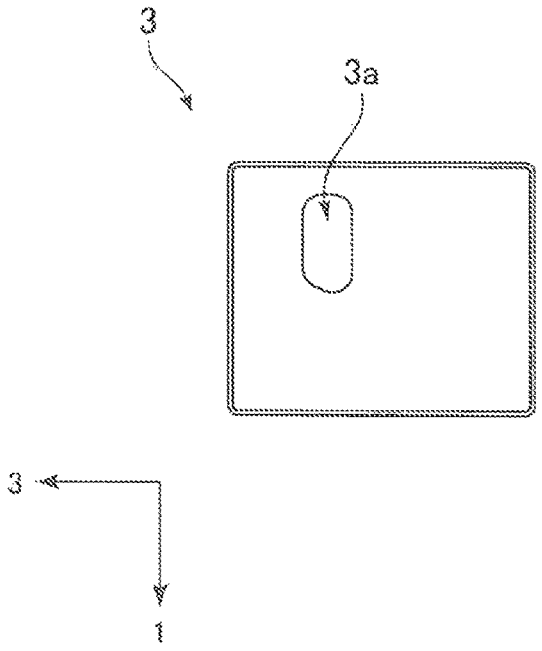
FIG. 7 is a right side view of the slider.
Figure 8:
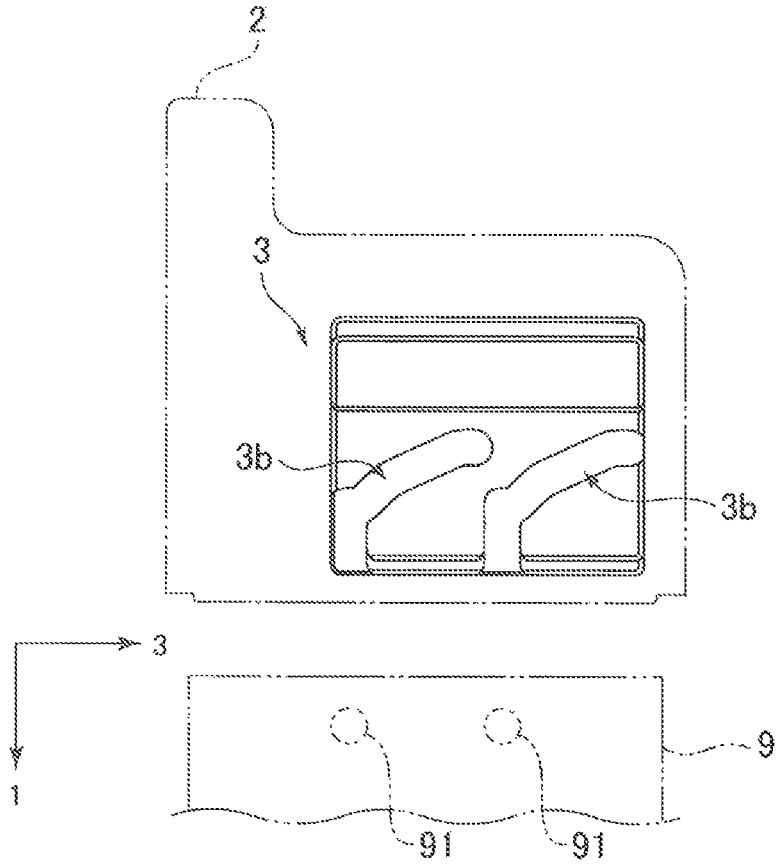
FIG. 8 is a left side view of the slider.
Figure 9:
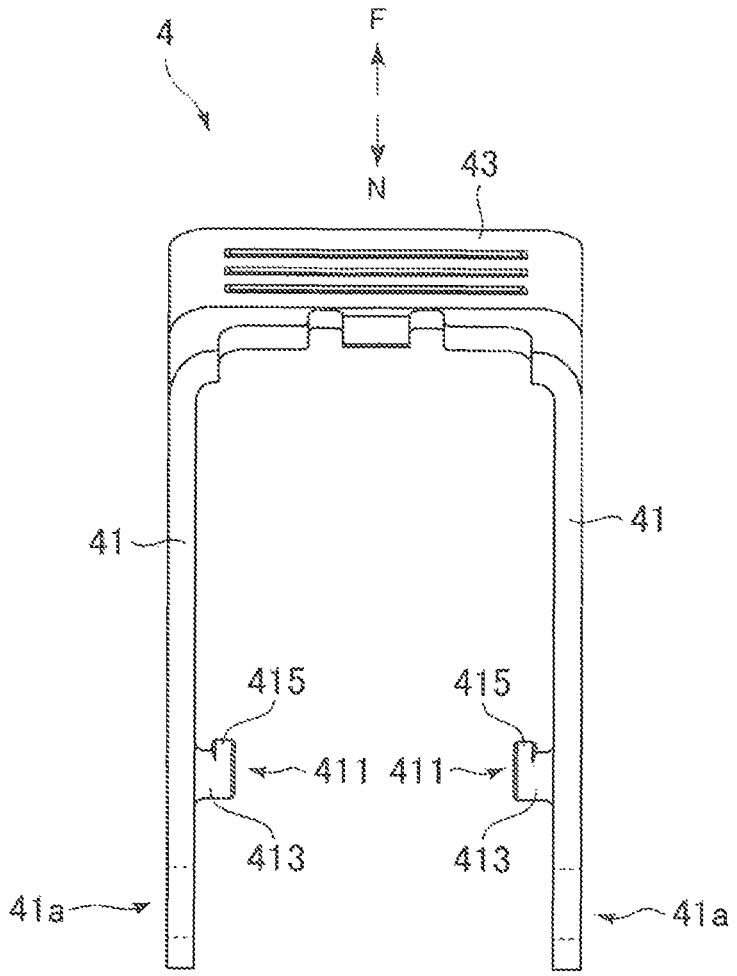
FIG. 9 is a front view of the lever.
Figure 10:
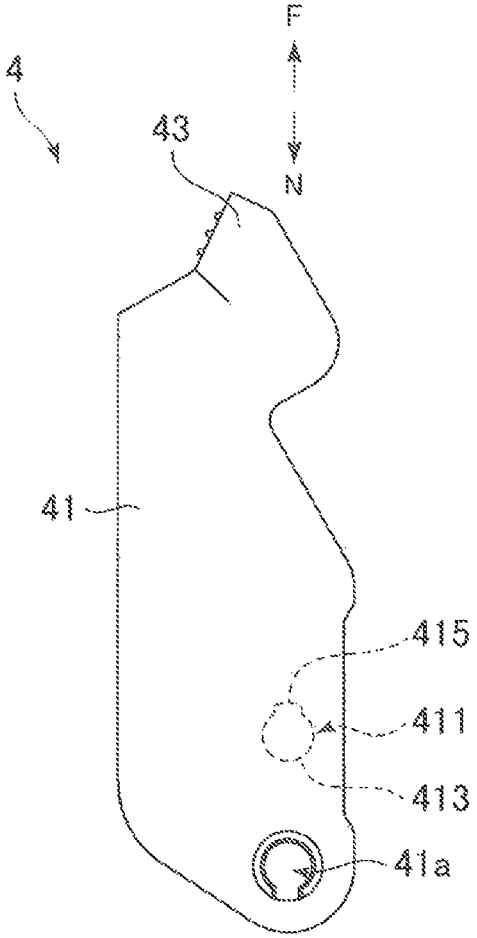
FIG. 10 is a right side view of the lever.

FIG. 1, FIG. 2, and FIG. 3 are a perspective view, a front view, and a right side view, respectively, of the connector 1 in an embodiment of the present disclosure. In FIG. 1, depiction of the slider 3 has been omitted. FIG. 4 and FIG. 5 are a front view and a right side view of the housing 2. FIG. 4 and FIG. 5 show the housing 2 accommodating the slider 3. FIG. 6, FIG. 7, and FIG. 8 are a perspective view, a front view, and a right side view, respectively, of the slider 3. In FIG. 8, engagement with the opposing housing 9 is depicted for explanatory purposes using two-dot chain lines. FIG. 9 and FIG. 10 are a front view and a right side view of the lever 4.

Figure 11:
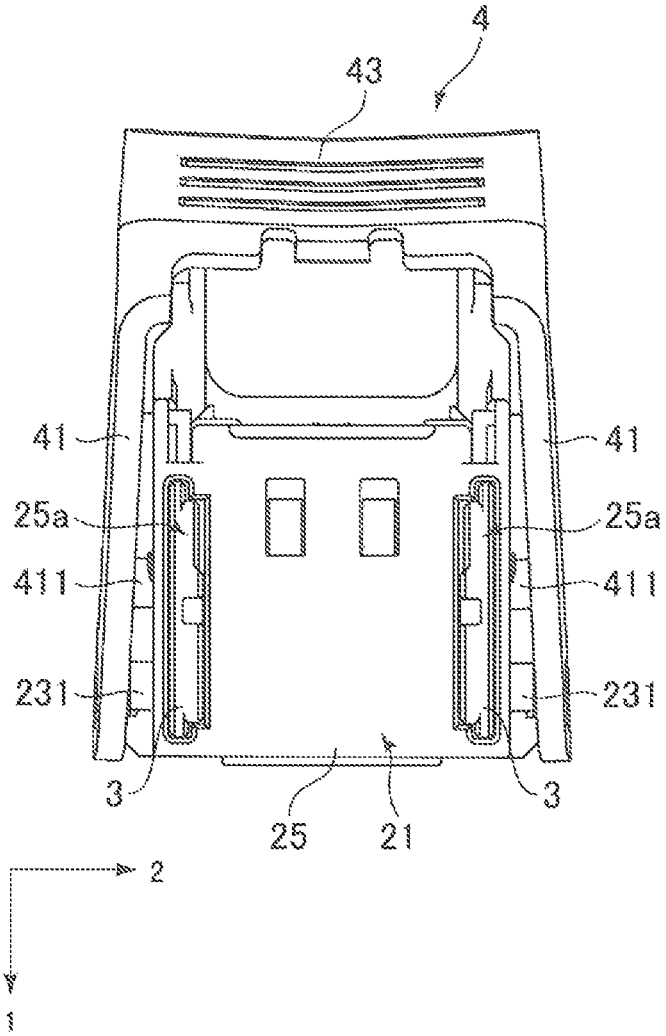
FIG. 11 is a front view used to explain how the lever is attached.
Figure 12:
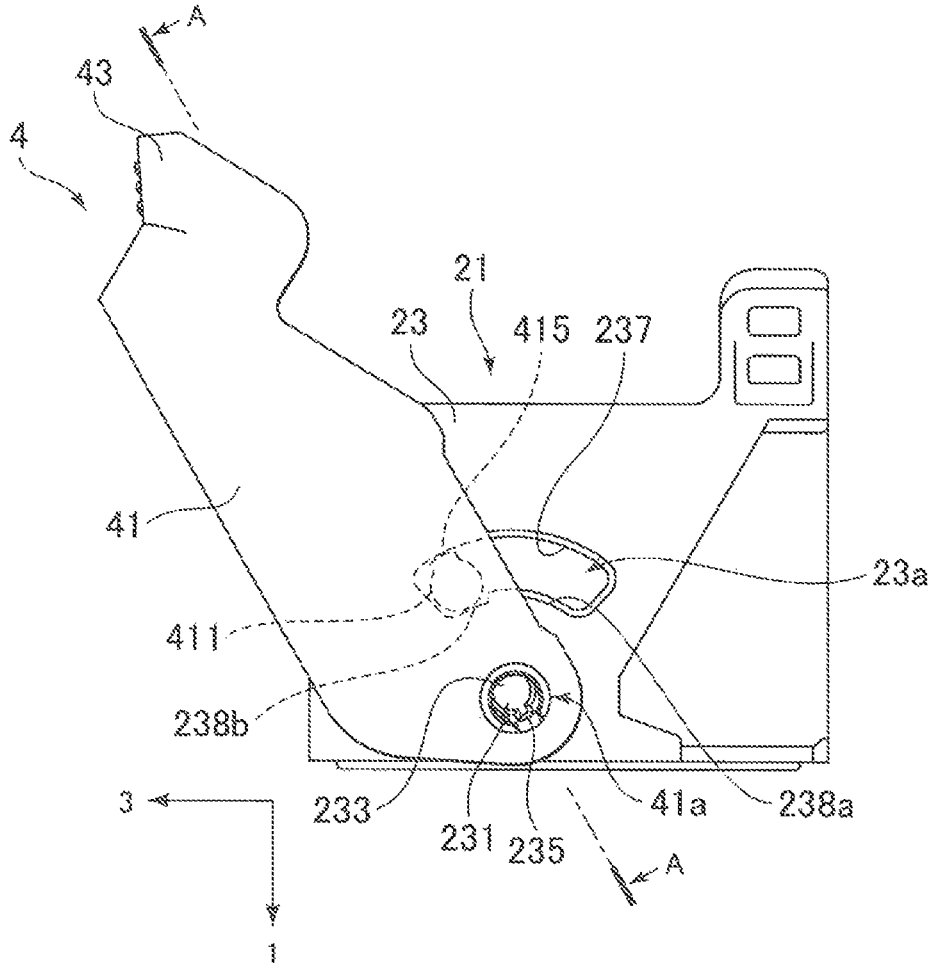
FIG. 12 is a right side view used to explain how the lever is attached.
Figure 13A:
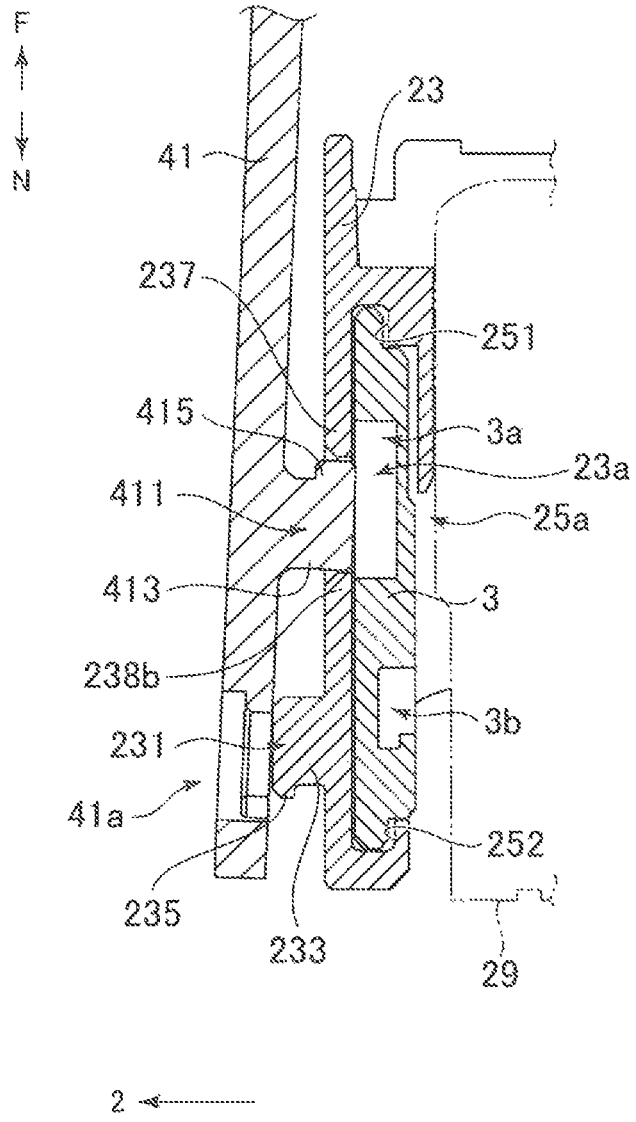
FIG. 13A is a cross-sectional view used to explain how the lever is attached.
Figure 13B:
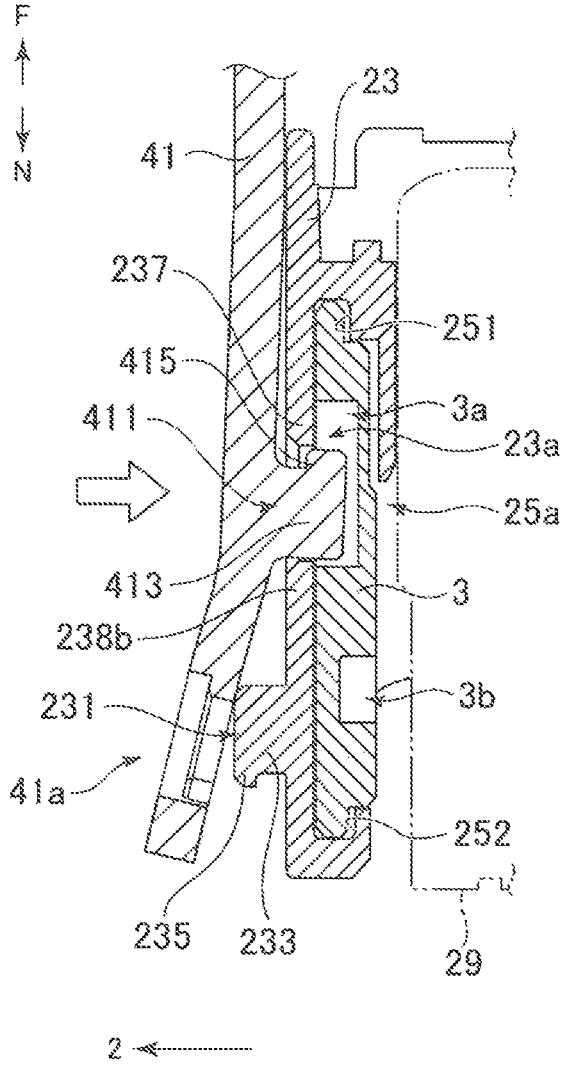
FIG. 13B is a cross-sectional view used to explain how the lever is attached.
Figure 13C:
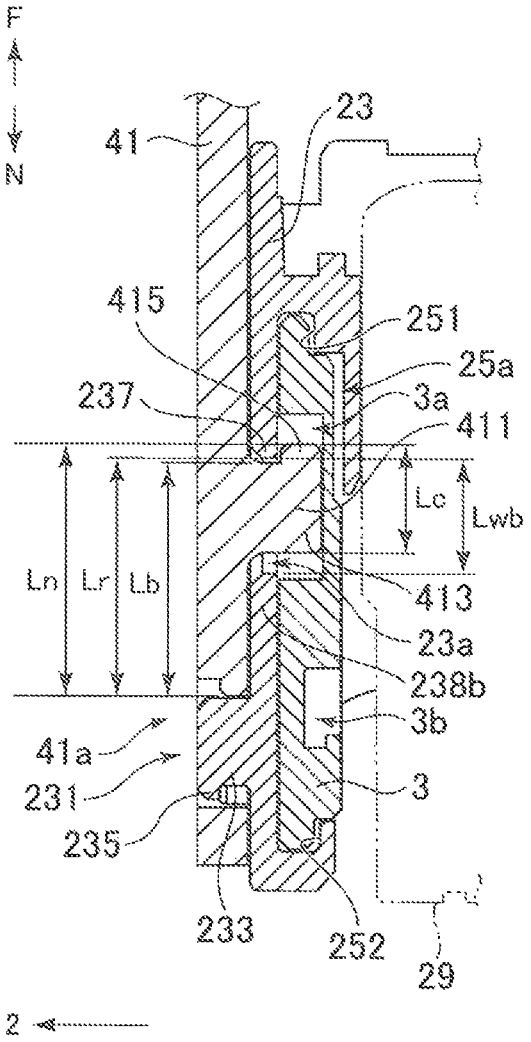
FIG. 13C is a cross-sectional view used to explain how the lever is attached.

FIG. 11, FIG. 12 and FIG. 13A through FIG. 13C are a front view, a right side view, and cross-sectional views, respectively, used to explain how the lever 4 is attached. FIG. 13A is a cross-sectional view from line A-A in FIG. 12. FIG. 13A through FIG. 13C show how the lever 4 is attached in stages.

In the specification and the drawings, the first direction is the direction in which the connector 1 is inserted and removed. In the first direction, the near side relative to the opposing housing 9 (see FIG. 8) is below, and the far side is above. The second direction is the direction orthogonal to the first direction, and is the normal direction of the long panel portion 23 of the housing 2. In the second direction, the side on which the slider 3 is positioned relative to the long panel portion 23 is the inside, and the side on which the lever 4 is positioned is the outside. The third direction is the direction orthogonal to the first and second directions, and is the direction in which the slider 3 accommodated in the housing 2 moves. In the third direction shown in FIG. 1, the side on which the leading end of the lever 4 is positioned is the disengaged side, and the side on which the protruding portion of the housing 2 is positioned is the engaged side.

The arrows at both ends of the single-dot chain line in FIG. 3 indicate the circumferential direction centered on the turning shaft portion 231, and indicate the directions in which the lever 4 turns. Arrows F and N on both ends of the solid line indicate the far side from the turning shaft portion 231 and the near side of the turning shaft portion 231 in the radial direction centered on the turning shaft portion 231.

As shown in FIG. 1 through FIG. 3, the connector 1 includes a housing 2, a slider 3 slidably accommodated in the housing 2, and a lever 4 supported turnably by the housing 2 which moves the slider 3. All of these components are made of a synthetic resin.

The housing 2 includes an outer shell portion 21 which is a case with a rectangular profile arranged so that the axial direction is in the first direction. The outer shell 21 includes a pair of long panel portions 23 facing each other in the second direction, and a pair of short panel portions 25 facing each other in the third direction. The long panel portions 23 each have a protruding portion 27 which protrudes upward.

A holding portion 29 for holding the terminals (see FIG. 13A through FIG. 13C) is arranged to the inside of the outer shell 21. The holding portion 29 may be integrated with the outer shell portion 21 or may be a separate component. When the housing 2 is fitted into the opposing housing 9 (see FIG. 8), the holding portion 29 is inserted into the opposing housing 9, and the outer shell portion 21 envelops the opposing housing 9.

As shown in FIG. 4 and FIG. 5, a turning shaft portion 231 protruding to the outside in the second direction is provided in the central portion of the long panel portions 23 in the third direction and in the bottom portion in the first direction. The turning shaft portion 231 includes a column-shaped base portion 233 and a hook portion 235 which protrudes from the base portion 233 in the radial direction to prevent detachment.

Arc-shaped windows 23*a* passing through in the second direction are formed in the central portions of the long panel portions 23 in the third direction and in the central portions in the first direction. The windows 23*a* have an arc shape centered on the turning shaft portion 231. The shape of the windows 23*a* is explained in greater detail below.

Insertion hole 25*a* for accommodating the slider 3 are formed in the long panel portions 23, and openings for the insertion holes 25*a* are formed in the short panel portion 25 on the disengaged side in the third direction. Rail grooves 251, 252 for movably holding the slider 3 in the third direction are formed above and below the insertion holes 25*a* (see FIG. 13A through FIG. 13C).

As shown in FIG. 6 through FIG. 8, the slider 3 is a rectangular panel. A cam groove 3*a* extending in the first direction is formed on the outer surface of the slider 3 in the second direction. When the slider 3 is accommodated in the housing 2, a portion of the cam groove 3*a* is visible in a window 23*a* formed in the long panel portion 23 (see FIG. 3 and FIG. 5).

An engaging groove 3*b* is formed on the inner surface of the slider 3 in the second direction. The engaging groove 3*b* extends towards the disengaged side in the third direction and upwards in the first direction. When the housing 2 is fitted into the opposing housing 9, the engaging protrusion 91 on the opposing housing 9 is inserted into the engagement groove 3*b* formed in the slider 3.

When the slider 3 is moved towards the engaged side in the third direction by the turning lever 4, the engaging groove 3*b* engages the engaging protrusion 91, and the action of the cam moves the housing 2 downward in the first direction. As a result, engagement of the housing 2 and the opposing housing 9 is completed, and the housing 2 is kept from moving in the first direction.

As shown in FIG. 9 and FIG. 10, the lever 4 includes a pair of panel-shaped arm portions 41 which face each other. A keyhole-shaped turning shaft hole 41*a* is formed at one end in the extension direction of each arm portion 41 for receiving an inserted turning shaft portion 231 on the housing 2. A bridge portion 43 spans the other end portion in the extension direction of the arm portions 41.

A cam shaft portion 411 is provided on the opposing inside surfaces of the arm portions 41 at a position on the side N nearer the turning shaft holes 41*a* than the middle point between the turning shaft holes 41*a* and the bridge portion 43. Each cam shaft portion 411 has a column-shaped base portion 413 and a hook portion 415 protruding from the base portion 413 in the radial direction to prevent detachment. Each hook portion 415 extends towards the far side F away from the turning shaft holes 41*a*.

A cam shaft portion 411 is passed through a window 23*a* formed in the outer shell portion 21 and is inserted into a cam groove 3*a* formed in a slider 3 (see FIG. 3 and FIG. 13A through FIG. 13C). The attachment of the lever 4 is explained below in greater detail.

When the lever 4 is turned around the turning shaft portion 231, the cam shaft portion 411 inserted into the cam groove 3*a* pushes the slider 3 primarily in the third direction, and this moves the slider 3 along the rail grooves 251, 252 in the third direction. The direction in which the slider 3 moves includes the third direction 3 but is not limited to the third direction alone.

In the embodiment explained above, the lever 4 is arranged to the outside of the housing 2, enabling the range of movement for the lever 4 to be expanded and increasing design freedom for the connector 1.

However, when the lever 4 is arranged to the outside of the housing 2, the force required to spread apart the pair of arm portions 41 is easier to generate, and the cam shaft portions 411 are more likely to become detached from the cam grooves 3*a*. This force is thought to be generated because the edges of the turning shaft hole 41*a* push the turning shaft portions 231 in the radial direction when the lever 4 is being turned, and the turning shaft portions 231 become deformed.

In the embodiment, as shown in FIG. 3 and FIG. 13C, a hook portion 415 on each cam shaft portion 411 is hooked on the edge 237 on the far side F of the window 23*a* from the turning shaft portion 231 on the inside of the long panel portion 23 in the second direction, which keeps the cam shaft portion 411 from detaching from the cam groove 3*a*.

More specifically, as shown in FIG. 13C, the distance Lr from the turning shaft portion 231 (or turning shaft hole 41*a*) to the edge 237 on the far side F of the window 23*a* is smaller than the distance Ln from the turning shaft hole 41*a* (or the turning shaft portion 231) to the end on the far side F of the hook portion 415 but greater than the distance Lb from the turning shaft hole 41*a* (or the turning shaft portion 231) to the end on the far side F of the base portion 413. These distances Lr, Ln, Lb are all centered on the turning shaft portion 231 in the radial direction.

As shown in FIG. 5 and FIG. 13C, the distance Lr from the turning shaft portion 231 to the edge 237 on the far side F of the window 23*a* is smaller than the distance Ln from the turning shaft portion 231 to the end on the far side F of the hook portion 415 along the entire edge 237. This keeps the cam shaft portion 411 from coming detached from the cam groove 3*a* no matter where the cam shaft portion 411 moved by the turning lever 4 is located in the window 23*a*.

The edge 238 on the near side N of the window 23*a* relative to the turning shaft portion 231 includes a section 238*a* in which the interval Lwa between it and the edge 237 on the far side F is smaller than the maximum diameter Lc of the cam shaft portion 411, and an edge 238 in which the interval Lwb between it and the edge 237 on the far side F is larger than the maximum diameter Lc of the cam shaft portion 411. Along the edge 238 on the near side N, the section 238*b* with interval Lwb is positioned on the disengaged side in the third direction. The maximum diameter Lc of the cam shaft portion 411 is the distance from the end on the near side N of the cam shaft portion 411 including the hook portion 415 to the end on the far side F.

This enables the cam shaft portion 411 pass through the window 23*a* in section 238*b* of interval Lwb, and the hook portion 415 to then engage the edge 237 on the far side F, thereby preventing the cam shaft portion 411 from detaching from the window 23*a* and the cam groove 3*a*. Also, when the cam shaft portion 411 is in section 238*a* with interval Lwa, interval Lwa is smaller than the maximum diameter Lc of the cam shaft portion 411 with the hook portion 415 engaging the edge 237 on the far side F, thereby preventing the cam shaft portion 411 from detaching from the cam groove 3*a*.

In addition, as shown in FIG. 3 and in FIG. 10, the hook portion 415 of the cam shaft portion 411 has a shape whose width narrows and whose end tapers from the turning shaft portion 231 as the far side F is approached. Thus, when the turning lever 4 moves the cam shaft portion 411, the hook portion 415 is kept from coming into contact with the inner surface of the cam groove 3*a*, and the base portion 413 is able to push against the inner surface of the cam groove 3*a*.

The following is an explanation of how the lever 4 is attached.

First, as shown in FIG. 11, FIG. 12 and FIG. 13A, the lever 4 is arranged so that the pair of arm portions 41 on the lever 4 sandwich the housing 2 accommodating the slider 3 in the second direction.

More specifically, the lever 4 is arranged so that the cam shaft portions 411 of the lever 4 are fitted into the disengaged side of the window 23*a* in the third direction. Because, as mentioned above, the edge 238 on the near side N of the window 23*a* relative to the turning shaft portion 231 has a section 238*b* in which the interval Lwb between it and the edge 237 on the far side F is larger than the maximum diameter Lc of the cam shaft portion 411, the cam shaft portion 411 can pass through the window 23*a* in section 238*b*.

However, as mentioned above, because the distance Lr from the turning shaft portion 231 to the edge 237 on the far side F of the window 23*a* is smaller than the distance Ln from the turning shaft hole 41*a* to the end of the hook portion 415 on the far side F, the cam shaft portion 411 cannot be inserted into the window 23*a* and the turning shaft portion 231 cannot be inserted into the turning shaft hole 41*a* as long as the arm portion 41 remains straight.

Therefore, as shown in FIG. 13B, the rear side of the cam shaft portion 411 of each arm portion 41 is pushed inward in the second direction using a finger.

In this way, the portion of each arm portion 41 between the cam shaft portion 411 and the turning shaft hole 41*a* becomes elastically deformed, and the cam shaft portion 411 is pushed into the cam groove 3*a*. At this time, when the hook portion 415 pass through the window 23*a* and reaches the cam groove 3*a*, the arm portion 41 moves from the turning shaft portion 231 to the far side F only by the protruding length of the hook portion 415, and the turning shaft portion 231 can be inserted into the turning shaft hole 41*a*.

As a result, and as shown in FIG. 13C, the cam shaft portion 411 can be inserted into the window 23*a*, and the turning shaft portion 231 can be inserted into the turning shaft hole 41*a*.

The hook portion 235 of the turning shaft portion 231 protrudes on the side opposite that of the hook portion 415 of the cam shaft portion 411. The turning shaft hole 41*a* also extends on the opposite side. Thus, when the arm portion 41 moves to the far side F from the turning shaft portion 231 by the protruding length of the hook portion 415 and the turning shaft portion 231 is inserted into the turning shaft hole 41*a*, insertion by the hook portion 235 can be inhibited.

An embodiment of the present disclosure was explained above, but the present disclosure is not restricted to this embodiment. It should be clear to a person of skill in the art that many other embodiments are possible.

What is claimed is:

1. A connector comprising:

a housing including an outer shell portion having an inside surface and an outside surface and facing a holding portion in a second direction orthogonal to a first direction when the first direction is a direction in which the holding portion holding a plurality of terminals is inserted into an opposing housing;

a slider held movably in a third direction orthogonal to the first direction and the second direction and between the holding portion and the outer shell portion, the slider having a cam groove configured to engage and disengage an engaging protrusion provided on the opposing housing in response to movement of the slider; and a lever including a turning shaft hole configured to turn around a turning shaft portion provided on the outside surface of the outer shell portion in the second direction, the lever having a cam shaft portion inserted through a window formed in the outer shell portion and into the cam groove formed in the slider.

2. A connector according to claim 1, wherein the cam shaft portion has a base portion and a hook portion extending from the base portion and hooking an edge of the window on the inside surface of the outer shell portion in the second direction.

3. A connector according to claim 2, wherein the window is arc shaped and includes a width defined by a near edge and a far edge, the near edge is closer to the turning shaft portion than the far edge and the hook portion extends beyond the far edge of the window.

4. A connector according to claim 3, wherein the cam shaft portion of the lever is inserted through the window of the outer shell portion, and the turning shaft portion of the outer shell portion is inserted into the turning shaft hole of the lever.

5. A connector according to claim 3, wherein the hook portion extends beyond the far edge of the window over the entire far edge of the window upon movement of the lever.

6. A connector according to claim 3, wherein the window includes a portion having a width allowing the base portion and hook portion of the cam shaft portion to pass through and a second portion having a width that prevents the base portion and hook portion of the cam shaft portion from detaching from the window.

7. A connector according to claim 3, wherein the hook portion having a width and the width decreases along a direction defined from the near edge of the window to the far edge of the window.

8. A connector according to claim 3, wherein the turning shaft portion has a hook portion protruding in a direction opposite from that of the hook portion of the cam shaft portion.

* * * * *